United States Patent [19]

Arai

[11] 3,981,601

[45] Sept. 21, 1976

[54] EXPANSION JOINT AND METHOD OF INSTALLING THE SAME

[76] Inventor: Motonosuke Arai, 4-12, Iwazono-cho, Ashiya, Hyogo, Japan

[22] Filed: Mar. 20, 1975

[21] Appl. No.: 560,481

Related U.S. Application Data

[63] Continuation of Ser. No. 361,024, May 17, 1973, abandoned.

[52] U.S. Cl. ..... 404/68; 14/16.5; 52/396

[51] Int. Cl.[2] ..... E01C 11/02

[58] Field of Search ..... 404/68, 69, 65, 64, 404/47, 48, 67; 14/16 J; 52/396

[56] References Cited

UNITED STATES PATENTS

| | | | |
|---|---|---|---|
| 3,218,941 | 11/1965 | Daum | 404/65 |
| 3,276,335 | 10/1966 | Middlestadt | 404/48 |
| 3,308,726 | 3/1967 | Dreher | 404/67 |
| 3,316,574 | 5/1967 | Pare | 14/16 |
| 3,387,544 | 6/1968 | MacLellan | 404/68 X |
| 3,430,544 | 3/1969 | Berks | 14/16 X |
| 3,570,378 | 3/1971 | Honegger | 404/69 |
| 3,713,368 | 1/1973 | McDowell | 404/69 |
| 3,810,707 | 5/1974 | Tungseth | 404/67 |
| 3,850,539 | 11/1974 | Bowman | 404/69 |

*Primary Examiner*—Nile C. Byers, Jr.
*Attorney, Agent, or Firm*—Auslander & Thomas

[57] ABSTRACT

An expansion joint comprising a joint member having opposing horizontal fixing bodies, such composed of a horizontal cushion course and a vertical cushion source made of elastic material on or under a steel flat horizontal base course, which are connected together by an expansion plate of elastic material that is formed in wave shape and comprises a flexible, flat part and an apex part, and stepped holes composed of a nut hole and an anchor bolt hole concentric with said nut hole made in said horizontal base course at regular intervals, and a method of installing such expansion joints by using an anchor bolt setter.

5 Claims, 31 Drawing Figures

EXPANSION JOINT AND METHOD OF INSTALLING THE SAME

This is a continuation of application Ser. No. 361,024 filed May 17, 1973 now abandoned. Cross reference the present application as a continuation of the invention as described in co-pending Ser. No. 361,024 filed May 17, 1973.

This invention relates to expansion joints useful for paving of roads, especially elevated roads and road bridges, and a method for installing such expansion joints.

In order to compensate for expansion and contraction of concrete pavement slabs caused by the change of ambient temperatures, it has been a usual practice to provide gaps or joint spacings (each having a width of several c.m.) in the concrete pavement slabs at regular intervals and a seal pacing or an expansion joint made of elastic material, such as rubber, synthetic resin or the like, is set in each gap.

Various types of expansion joint now in use and problematical points raised in each type are enumerated below.

A. Steel comblike joint

This is an expansion joint comprising opposing comblike steel plates, fixed respectively at the upper end of the web of a base member provided at opposing edges of adjacent concrete pavement slabs in such a fashion that their teeth are interlocked at the road surface, and also a water-table and a drainage appliance are provided under said steel plates. This type of joint has the following disadvantages.

1. Since warp is caused after welding in manufacturing these joints, joints must be carried to the construction field as they are applied with patches. Therefore, difficulty is found in installing and repairing these joints, with resultant higher costs.

2. Concrete is not fully filled under comblike steel plates, in other words, some cavities are left under them after concreting. Therefore, if such comblike steel plates are fixed by welding, the welded part under which some cavities exist is liable to break by the load of vehicles passing over it.

3. As rainwater and dust enter through gaps between opposing comblike steel plates, the steel plates get rusty easily and drainage appliances are needed.

4. When re-paving the surface of road, it is impossible to effect overlaying.

5. Once damage has been caused to the joint, whenever a vehicle passes over the joint, noises are emitted because of property of steel plate.

B. Hollow joint made of rubber

This expansion joint is of the type that resin concrete having cement or epoxi resin as the principal material is filled in recesses provided at opposing edges of adjacent concrete pavement slabs and a hollow expansion joint made of rubber is interposed in a gap between adjacent concrete end faces. This type of joint has the following disadvantages.

1. Resin concrete is easy to be cracked and damaged.

2. If the extent of expansion and contraction of the hollow expansion joint made of rubber exceeds 25m.m., a load applied to the expansion joint becomes larger, with the result that the expansion joint becomes easy to break due to its fatigue.

C. Both-end fixed expansion joint made of rubber

This expansion joint is of the type that both ends of a rubber expansion member comprising a plurality of parallel vertical plates through which a horizontal rod is passed at the center and connected at their upper and lower ends with rubber, are fixed to opposing edges of adjacent concrete pavement slabs. This joint has the following disadvantages.

1. Due to the load of vehicles passing over it, parallel vertical plates cut into rubber and accordingly the rubber is liable to be cut.

2. Due to the load of vehicles passing over it, the horizontal rod turns upright and the fixing parts at the opposing edges of adjacent concrete pavement slabs are easy to break.

3. The construction in which joints are installed is complicated and more reinforcing material is required, with resultant difficulty in installing joints.

Joints (A) are used in cases where the bridge length is longer and a width of joint spacing between a pair of pavement slab sections is larger. In cases where the bridge length is shorter, either joints (B) or joints (C) are used.

Various joints other than the above (A), (B) and (C) types have been devised. However, the fact is that any of these types, when used for the expressway, begins to be damaged at both end portions of the pavement slab to which the expansion joint is fixed, after the lapse of several years and naturally requires repairing. It has been known that one of the factors for such damage is high strength which acts upon the joint fixed portions at edges of the concrete pavement slab. Also, the conventional expansion joint has such demerits that if it is damaged partially, such damage grows larger and larger due to vibration by vehicles passing over it. This causes the necessity of repairing the joints of pavement one after another, which involves traffic stagnancy due to temporary blocking of a road during repairing. Such being the case, development of durable expansion joints for pavement which can be installed easily has been earnestly desired.

In view of the above-mentioned demerits of conventional expansion joints, due consideration was given to the following points in the present invention.

a. Construction which is free from the concentrated load being applied to any part of the joint, different from the above-mentioned steel comblike joint wherein concentrated load is applied to the welded part of comblike plates by vehicles passing over.

b. The joint member in such construction that tensile strength which acts upon opposing ends of adjacent concrete slabs is small.

c. The joint member which is perfectly water-tight and is fixed firmly to opposing ends of adjacent concrete slabs.

d. The joint member in such construction that its elastic part is so firmly connected to the joint fixing part at both ends that it will not break even by repeated load applied thereto by vehicles passing over.

e. The joint member which involves less vibration when a vehicle passes over it and accordingly gives better feeling of travelling.

f. Easiness and quickness in installing joint members, reinforcing material and other members.

g. Easiness of post-concreting and the method of installing which involves no gap between the joint member and concrete which is liable to take place due to inherent shrinkage characteristic of concrete.

h. Correctness with which anchor bolts can be fitted in concrete slabs in a proper position and at a proper degree of perpendicularity.

i. Easiness with which joint members can be replaced in repairing.

An object of the present invention is to compose a joint member comprising a pair of cushiony, flat fixing bodies which are arranged in horizontal direction with a certain space therebetween and are connected with each other by a wave-shaped expansion plate made of soft and elastic material, such as synthetic resin, and to install said joint member in such a fashion that bottom surfaces of the fixing bodies are fixed fast onto the base of road joint, thereby eliminating the application of concentrated load and preventing water leakage and thus meeting of the requirements of the above (a) and (c).

Another object of the present invention is to form a flexible part of the expansion plate of joint member, using a rather thin elastic plate material, in V-shape, wave-shape, etc. in its cross section in lengthwise direction, thereby allowing free expansion and contraction of the expansion plate in horizontal direction and thus meeting the requirement of the above (b).

A further object of the present invention is to make the part at which the expansion plate is connected to the fixing body thicker than the expansion plate itself, thereby increasing the coherence of the expansion plate and the fixing body and preventing the expansion plate from breaking even under the application of strong load thereto and thus meeting the requirement of the above (d).

Still another object of the present invention is to provide a horizontal cushion course on and/or under the horizontal base course of the joint member and also to provide a vertical cushion course inside the horizontal base course, thereby absorbing shocks which are generated when a vehicle passes over the fixing body and thus meeting the requirement of the above (e).

Another object of the present invention is to provide a narrow groove at an apex part of the expansion plate, thereby preventing the break of the apex part and meeting the requirement of the above (d).

Yet another object of the present invention is, for advantaging the production and transportion, to produce joint members in a specified length, within the range of 1m – 2m, so that they can be installed and connected in the road width direction or transversal direction. Besides, in order to ensure perfect connection of joint members, each joint member is provided with a convexed portion and a concaved portion at either extreme end for the purpose of fit-in connection or the expansion plate is provided with protuberances for the purpose of overlap connection, thereby avoiding water leakage and improving coherence and thus meeting the requirements of the above (c) and (d).

Another object of the present invention is to make a plurality of stepped holes in the fixing body of the joint member at regular intervals and to fit a perpendicular screw part of an anchor bolt fixed beforehand to the concrete slab or the fixing member in each of said stepped holes, thereby facilitating installing and removing of the joint member and ensuring accurate fastening of the joint member and thus meeting the requirements of the above (g) and (i).

Still another object of the present invention is to stick the underside of the fixing body fast to the surface of the base of road in its entirety by applying a solution of thermo-hardening resin, such as epoxi resin, polyester resin, etc., to the surface of the base of road, thereby meeting the requirements of the above (a), (c), (e), (f) and (g).

An object of the present invention is to form the anchor bolt in such a fashion that a nut which abuts the bottom of the fixing body of the above-mentioned joint member can be welded to the lower part of its screw part, its lower half part is bent and it has a hooked part at its top portion, whereby screw parts of anchor bolts are made uniform in height when connecting anchor bolts to reinforcing bars, using an anchor bolt setter to be mentioned hereinafter, and positioning of anchor bolts can be effected easily by turning the hooked part and thus meeting the requirement of the above (f).

Another object of the present invention is to install the above-mentioned anchor bolts by using an anchor bolt setter comprising a frame made by combining members in lengthwise direction and members in transversal direction, thereby effecting correct perpendicularity and positioning of the anchor bolt easily, with the result of quick installation of joint members, and thus meeting the requirements of the above (f), (g) and (h).

The nature and advantages of the present invention will be understood more clearly from the following description made with reference to several embodiments and accompanying drawings, in which:

FIG. 1 – FIG. 4 illustrate the first embodiment, in which FIG. 1 is a vertical section of the expansion joint, taken on line I — I in FIG. 2; FIG. 2 is a plan view of FIG. 1; FIG. 3 is an enlarged view of the part encircled with a chain line in FIG. 1; FIG. 4 is a sketch showing the state in which a wheel of vehicle passes over the joint.

Figure 1:
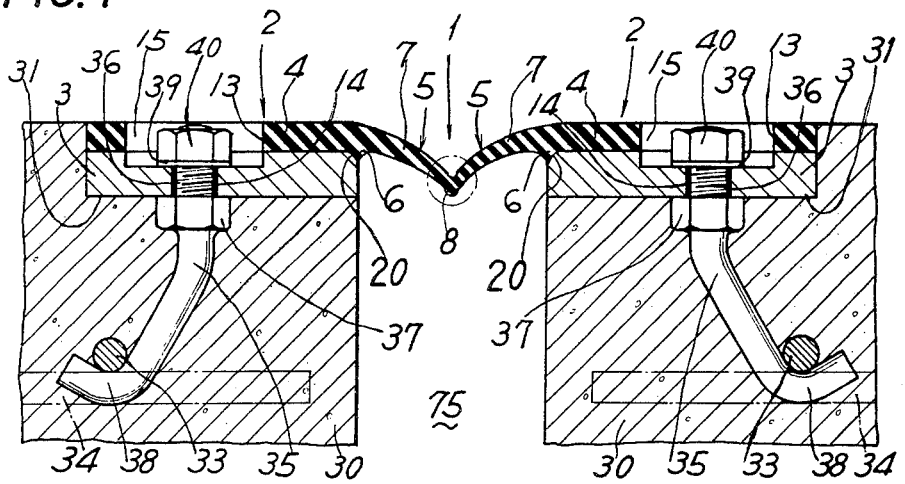
Figure 2:
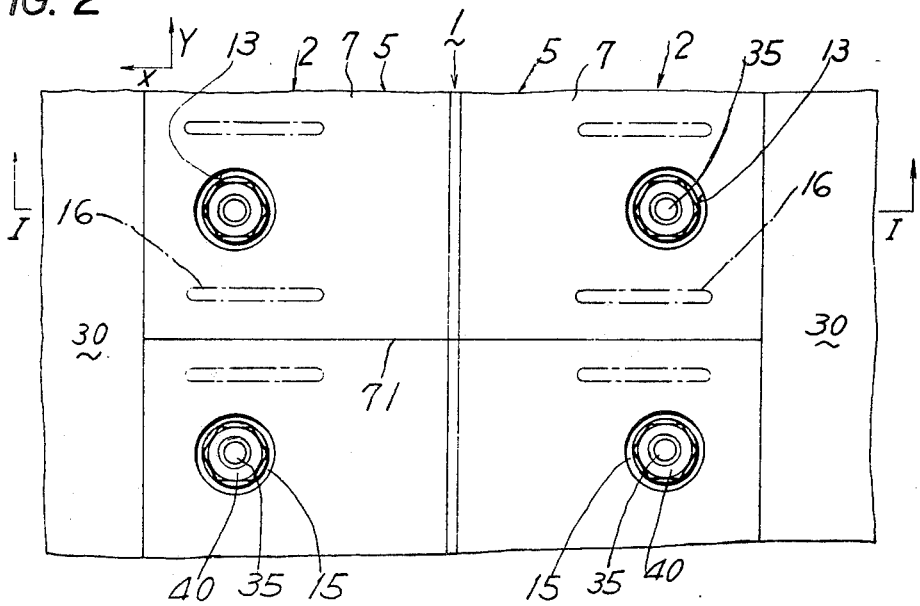
Figure 3:
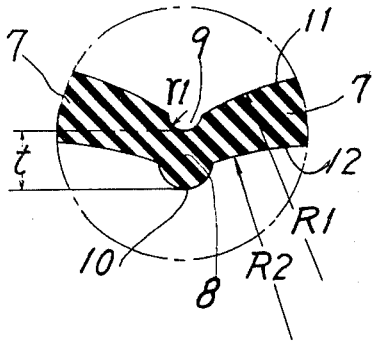
Figure 9:
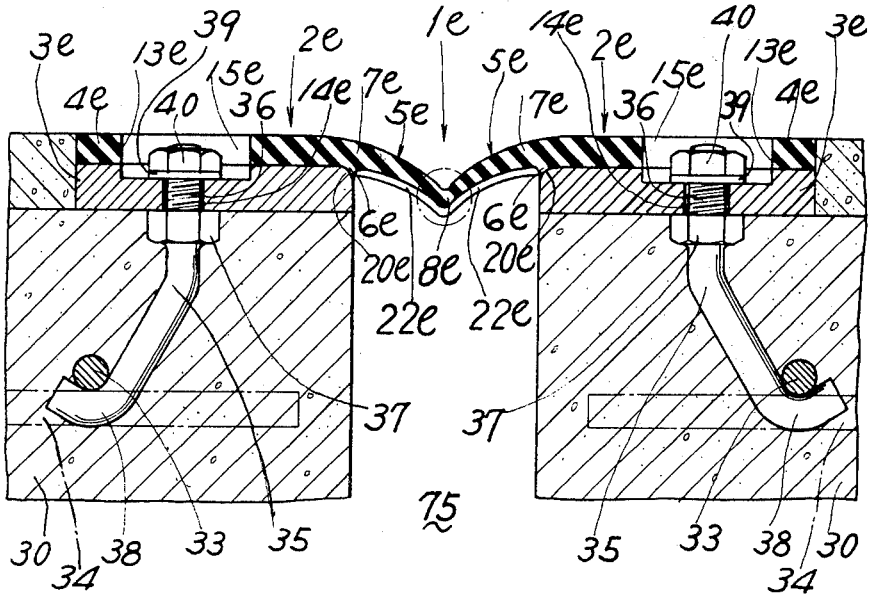
Figure 10:
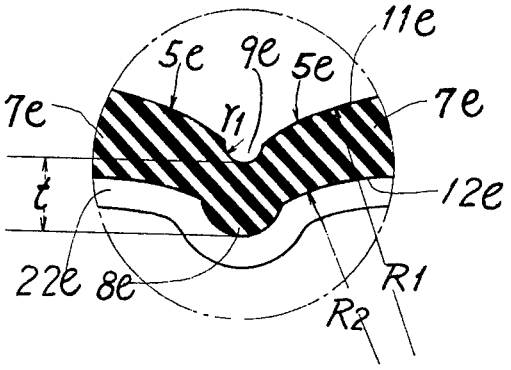
Figure 11:
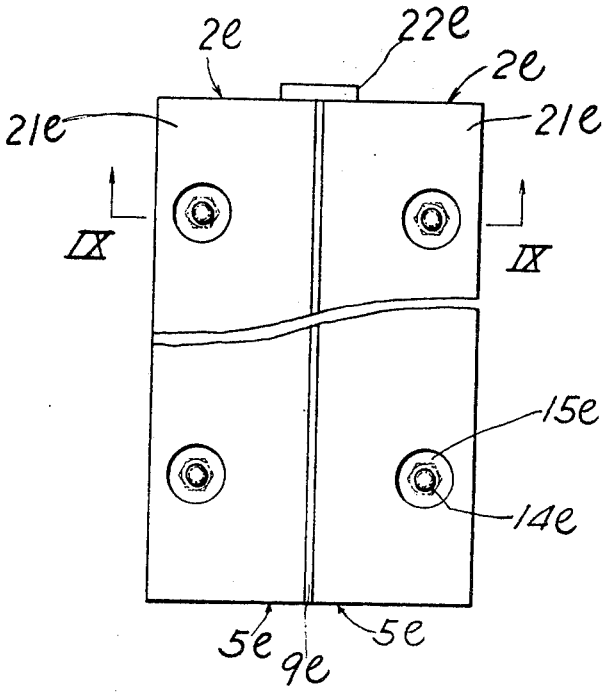

FIG. 9 – FIG. 11 illustrate the sixth embodiment, in which FIG. 9 is a vertical section, similar to FIG. 1; FIG. 10 is an enlarged view of the part encircled with a chain line in FIG. 9; FIG. 11 is a plan view of the joint member.

Figure 12:
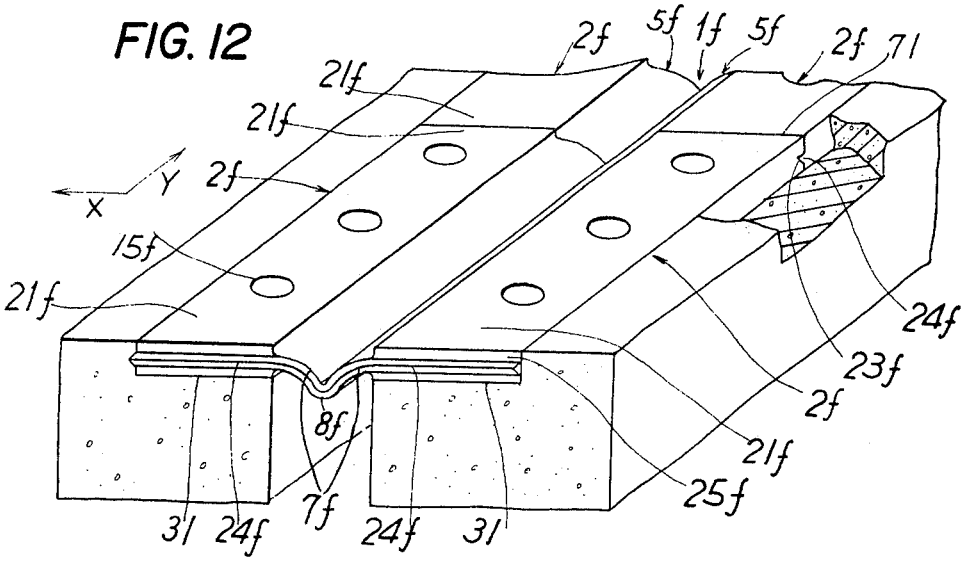
Figure 13:
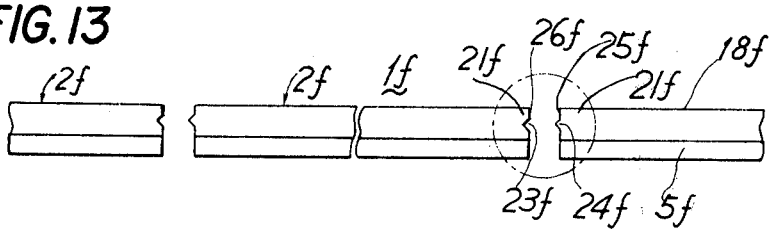
Figure 14:
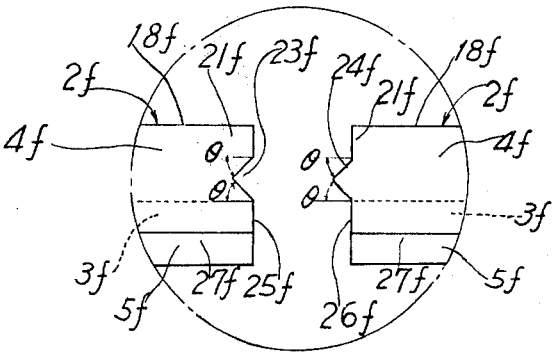

FIG. 12 – FIG. 14 illustrate the seventh embodiment, in which FIG. 12 is a perspective view of a part of the expansion joint as cut off at the connected part of the joint member; FIG. 13 is a side elevation of the joint member; FIG. 14 is an enlarged view of the part encircled with a chain line in FIG. 13.

Figure 15:
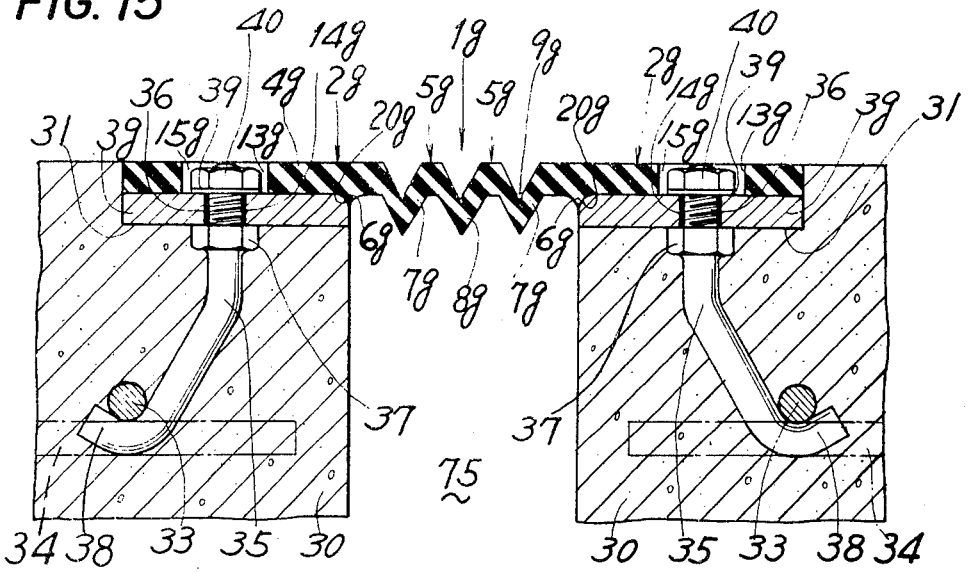

FIG. 15 illustrates the eighth embodiment and is a vertical section, similar to FIG. 1.

Figure 5:
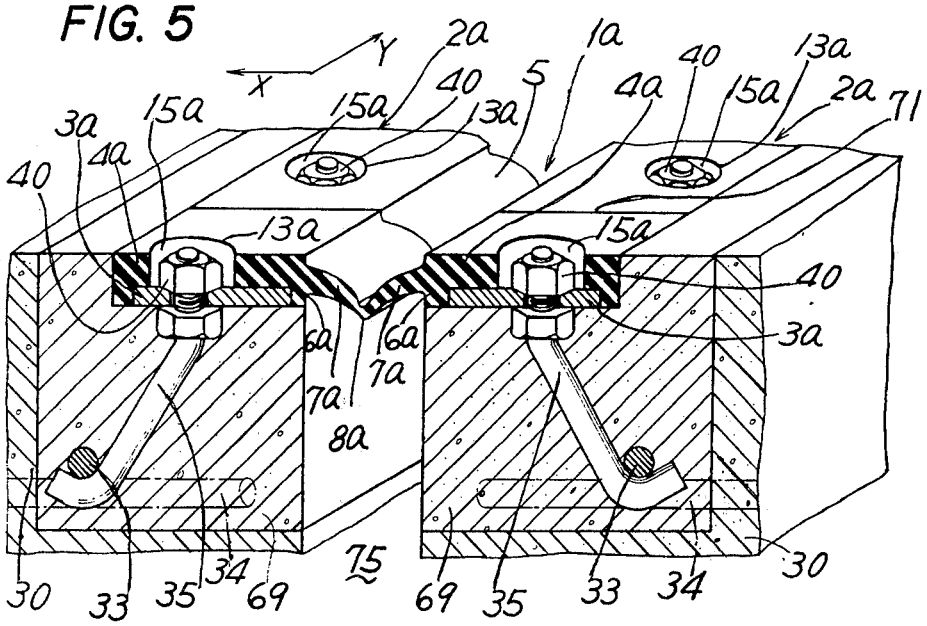
FIG. 5 illustrates the second embodiment and shows a perspective view of a part cut in lengthwise direction.
Figure 16:
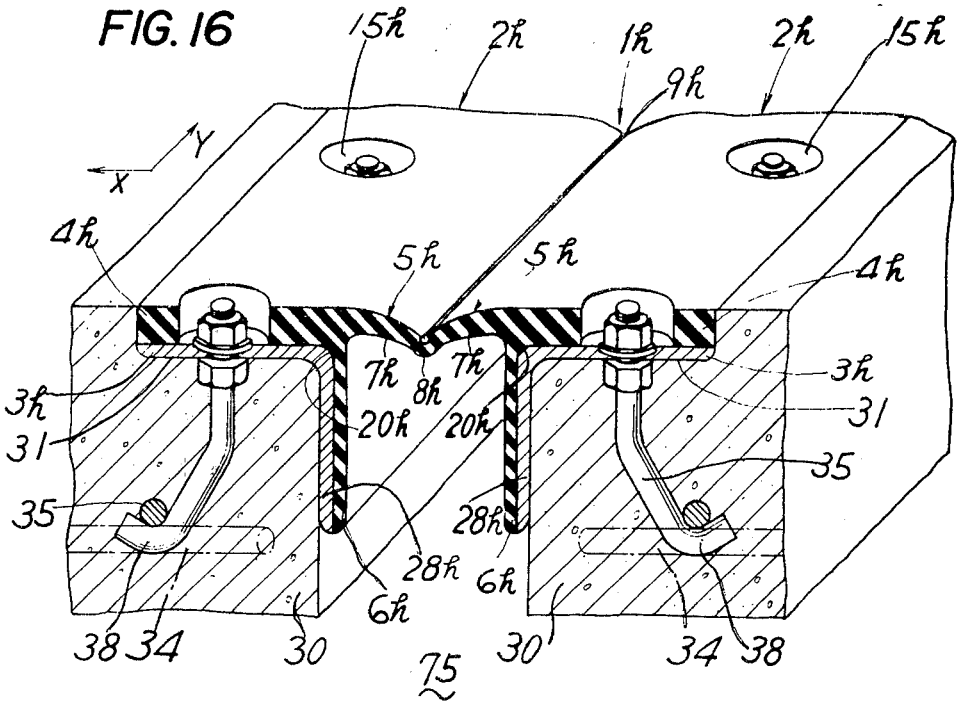

FIG. 16 illustrates the ninth embodiment, giving a perspective view similar to FIG. 5.

Figure 17:
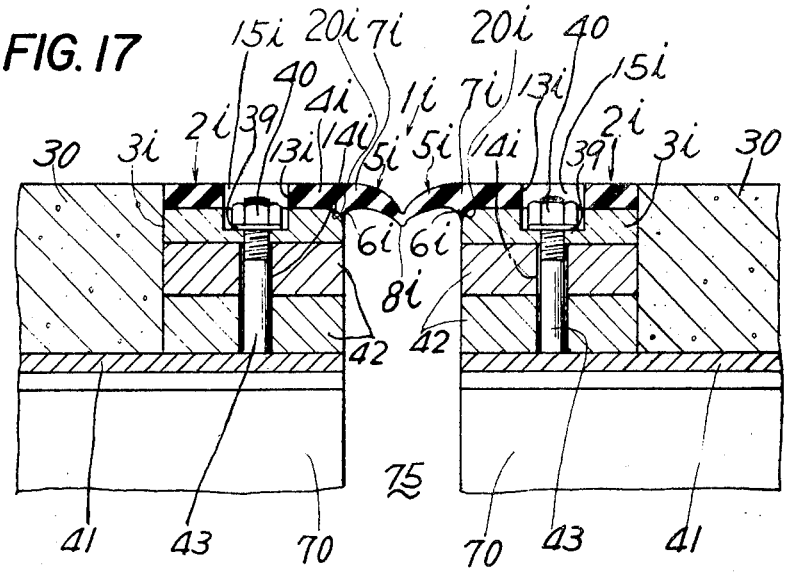

FIG. 17 illustrates the tenth embodiment and is a vertical section, similar to FIG. 1.

Figure 18:
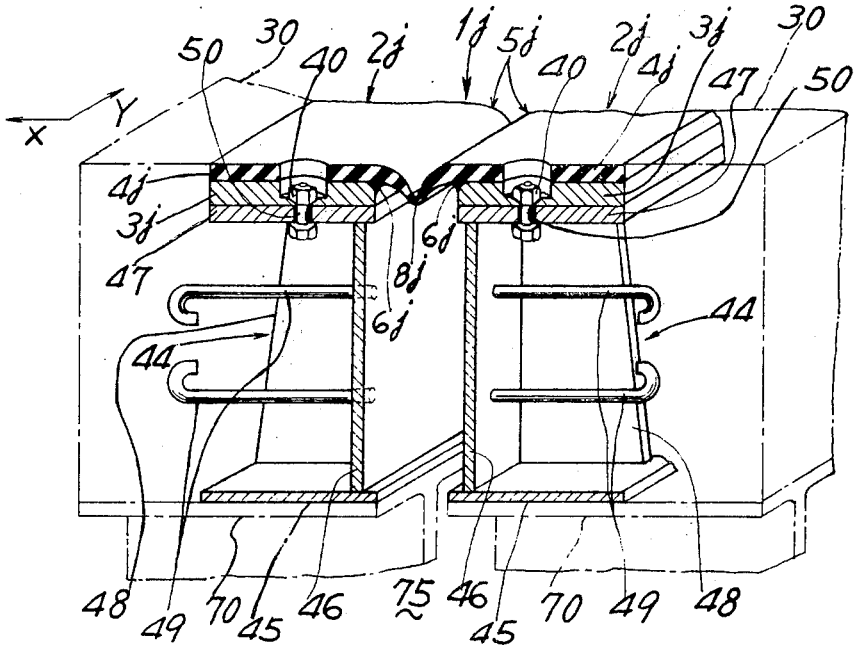

FIG. 18 illustrates the eleventh embodiment in vertical section, similarly to FIG. 5 but gives a perspective view showing concrete and other parts by a chain line and also showing the construction of an installation table.

Figure 19:
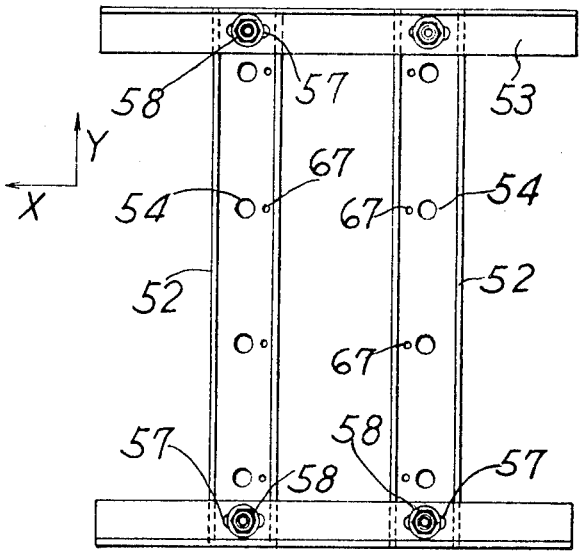
Figure 20:
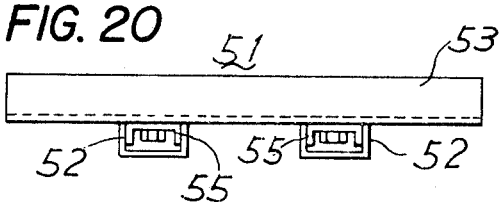
Figure 21:
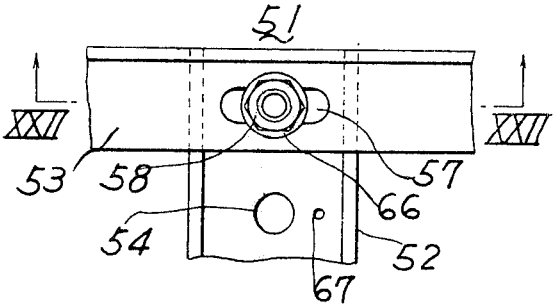
Figure 22:
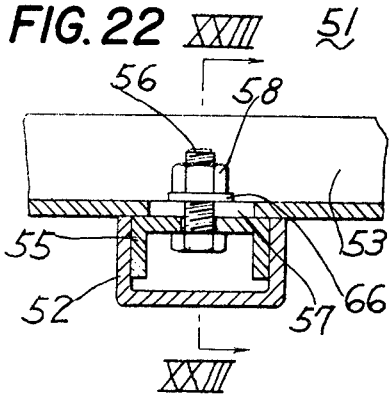
Figure 23:
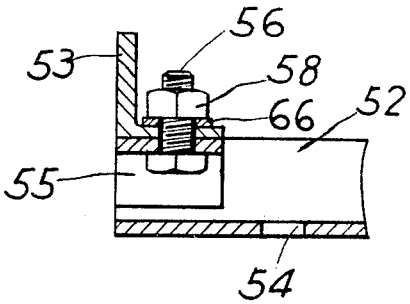
Figure 24:
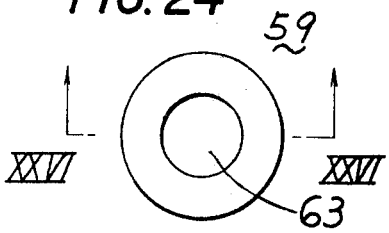
Figure 25:
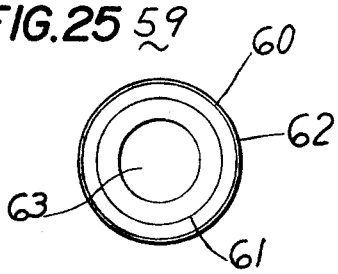
Figure 26:
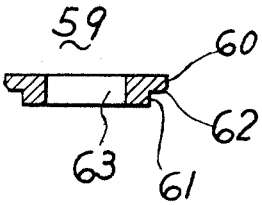
Figure 27:
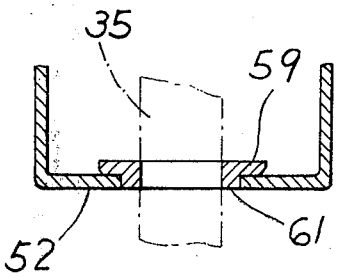
Figure 28:
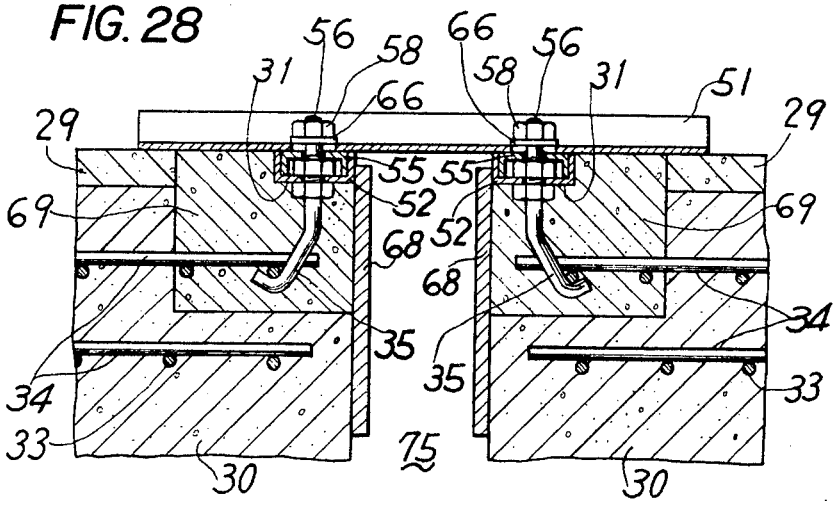
Figure 29:
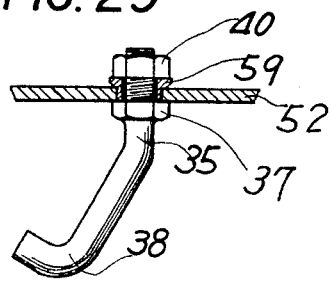
Figure 30:
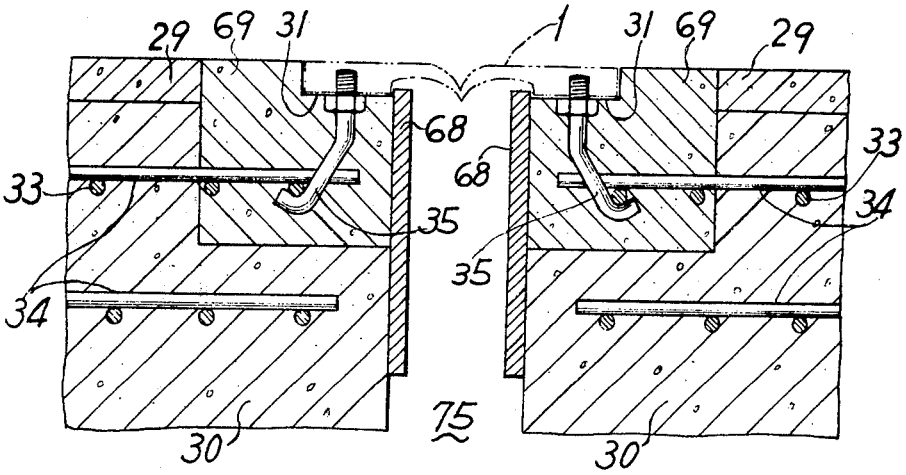

FIG. 19 – FIG. 30 illustrate respectively a method of installing the expansion joint according to the present invention, in which FIG. 19 is a plan view of an anchor bolt setter; FIG. 20 is a front view of the anchor bolt setter shown in FIG. 19; FIG. 21 shows a part of the anchor bolt setter, on an enlarged scale, given in FIG. 19; FIG. 22 is a cross sectional view of the part, taken on line XXII — XXII in FIG. 21; FIG. 23 is a cross sectional view of the part, taken on line XXIII — XXIII in FIG. 22; FIG. 24 is a plan view of a stepped washer; FIG. 25 is a bottom view of the stepped washer in FIG. 24; FIG. 26 shows a cross section of the part, taken on line XXVI — XXVI in FIG. 24; FIG. 27 is a cross sectional view, illustrating the stepped washer as it is fitted in a member in road width direction of the anchor bolt setter; FIG. 28 is a cross section in lengthwise direction of the road, showing the state in which anchor bolts are set in the joint of road, using an anchor bolt setter; FIG. 29 shows the state in which the anchor bolt and the stepped washer are interlocked. FIG. 30 is similar to FIG. 28 but shows the state to be presented after the anchor bolt setter was removed from its position shown in FIG. 28.

Figure 31:
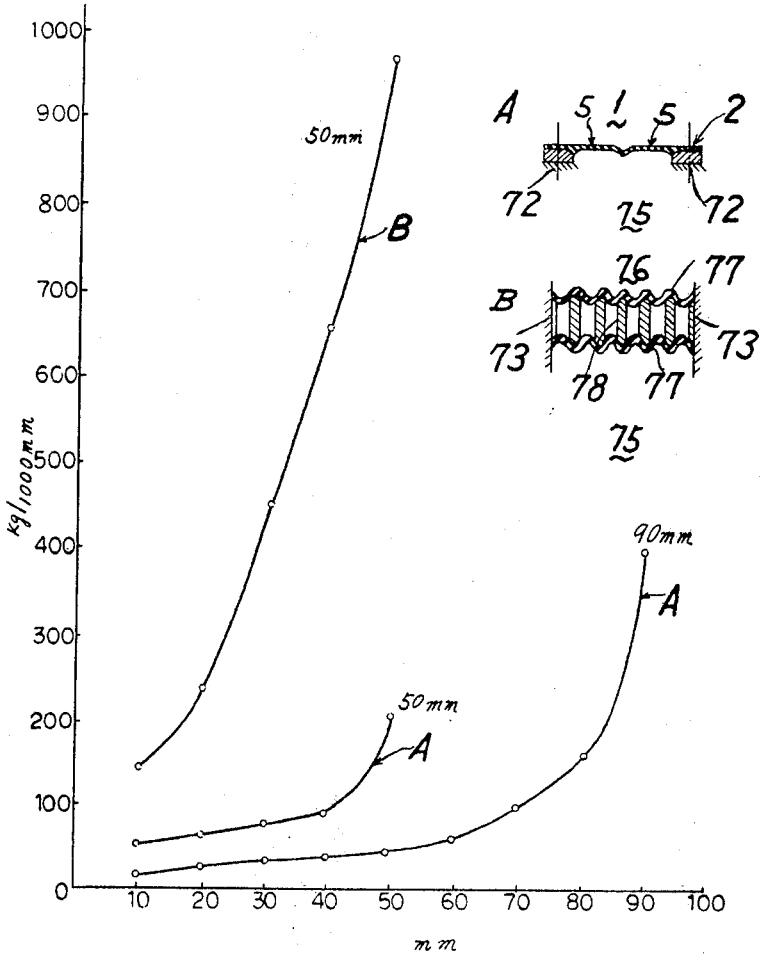

FIG. 31 shows the load-compression curves of the joint member according to the present invention (A type) and of the conventional joint member (B type).

The composition of the present invention is described below with reference to the following embodiments and accompanying drawings.

EMBODIMENT NO. 1

This embodiment is shown in FIG. 1 – FIG. 4. Numeral 1 denotes a joint member having, in its lengthwise cross section, horizontal and flat fixing bodies 2 facing each other. The fixing body 2 has a horizontal cushion course 4 of elastic material, such as rubber, synthetic resin or the like, which is on a flat steel horizontal base course 3. A vertical cushion course 6 or rib made of the same elastic material as the horizontal cushion course 4 is provided on a recessed part 20 or fillet arranged inside the horizontal base course 3. The horizontal cushion course and the vertical cushion course are connected together by an expansion plate 5 of the same elastic material. These horizontal cushion course 4, vertical cushion course 6 and expansion plate 5 are moulded in a body in a cavity between male and female metallic patterns in which a plate-shape elastic material is put to be given heating and pressure. The horizontal base course 3 is set beforehand in both sides of a moulding apparatus in order to have the elastic material melt and stick to the horizontal base course 3. The expansion plate 5 formed in wave-shape has a flexible, flat part 7 and an apex part 8 which protrudes downwardly. The upper surface of the apex part 8 is formed into a narrow groove with the radius of curvature $r_1$ (equivalent to approximate 1/5 – 2/5 of the thickness of the lowest part $t$) and its under surface is formed into a protuberance of curved surface 10 with the radius of curvature $r_2$ (equivalent to approximate ½ – 7/10 of the thickness $t$). An upper surface 11 of said flat part 7 which is a curved surface with the radium of curvature $R_1$ several times larger than the size of said thickness $t$ is continuous to the narrow groove 9 and an under surface 12 of the flat part 7, which is a curved surface of the radius of curvature $R_2$ (smaller than the radius of curvature $R_1$) is continuous to the protuberance of curved surface 10. Made in the opposing fixing bodies 2 in lengthwise direction of the joint member thus formed are stepped holes at regular intervals. This stepped hole 15 comprises a nut hole made in the horizontal cushion course 4 and in the upper half part of the horizontal base course 3 and an anchor bolt hole 14 which is made in the lower half part of the horizontal base course 3, concentric with said nut hole.

The executing sequence of this embodiment is described below. Provided in the transversal direction on the edges of opposing concrete pavement slabs 30 with a certain space therebetween at the joint of a road bridge are shoulder parts 31, which serve as the bases for fixing the fixing body 2. Said shoulder part 31 is made by post-concreting 69 (which forms a part of the concrete pavement slab 30 when hardened) a recessed part of the concrete pavement 30, so as to obtain the thickness and width of the fixing body 2. On said shoulder part, arranged in transversal direction at the same position as the stepped hole 15 of the said fixing body 2 is an anchor bolt 35 whose base part 38 is joined with a main steel bar 33, namely, a reinforcing material. The top end of said anchor bolt 35 is threaded. Before installing the joint member 1, a solution of thermo-hardening resin, such as epoxy resin and polyester resin, is applied onto the upper surface of concrete base of the shoulder part 31. Then, the anchor bolt 35 is mounted on the shoulder part 31 through the anchor bolt hole 14 of the fixing body 2, and the fixing body 2 is fixed on the concrete pavement slab 30 by binding the top end of the anchor bolt 35 with a binding nut 40, through the medium of a washer 39. Then, a synthetic resin solution is poured into the nut hole 13 in order to fix the binding nut 40. Joint members 1, produced in the length between 1.0m and 1.8m in the transversal direction and carried to the construction field, are set connectively to one another according to the width of a road to be paved. A joint 71 is provided between abutting joint members. Numeral 16 denotes a shallow groove for preventing vehicle tires from slipping. A plurality of this groove are made in the lengthwise direction on the fixing body 2.

EMBODIMENT NO. 2

This embodiment is shown in FIG. 5. In a joint member 1*a*, similarly to Embodiment No. 1, a fixing body 2*a* comprises a horizontal cushion course 4*a* on a horizontal base course 3*a* and a vertical cushion course 6*a* inside said horizontal cushion course. Said horizontal cushion course and said vertical cushion course are connected together by an expansion plate 5*a*. The surface and both sides of the horizontal base course 3*a* are covered with elastic material. A flat part 7*a* is continuous to the fixing body 2*a* at the position a little lower than the upper surface of the latter. A nut hole 13*a* is made through the fixing body 2*a*, and an anchor bolt hole concentric with said nut hole through the horizontal base plate. Other shapes and construction and the executing sequence are the same as in the case of Embodiment No. 1. The characters of reference for the joint member 1*a* are represented by adding *a* to those of corresponding parts in Embodiment No. 1.

EMBODIMENT NO. 3

Figure 6:
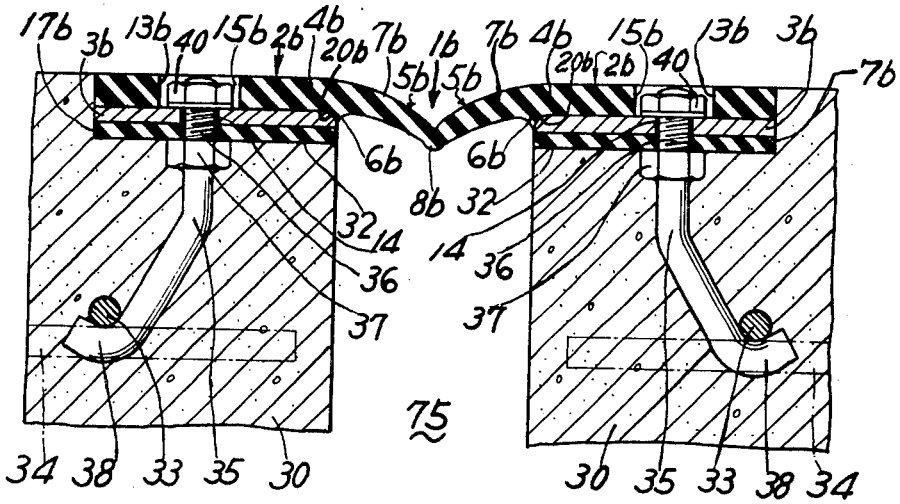
FIG. 6 – FIG. 8 illustrate respectively a vertical section of the third embodiment, the fourth embodiment and the fifth embodiment in due order.

This embodiment is shown in FIG. 6. A fixing body 2*b* of a joint member 1*b* has a lower flat horizontal cushion course 17*b* of elastic material, such as rubber, synthetic resin or the like, which is fixed under a horizontal base course 3*b*. A horizontal cushion course 4*b*, a vertical cushion course 6*b*, an expansion plate 5*b*, other shapes and construction and the executing sequence are the same as in the case of Embodiment No. 1. The characters of reference for the joint member 1*b* are represented by adding *b* to those of corresponding parts in Embodiment No. 1.

EMBODIMENT NO. 4

Figure 7:
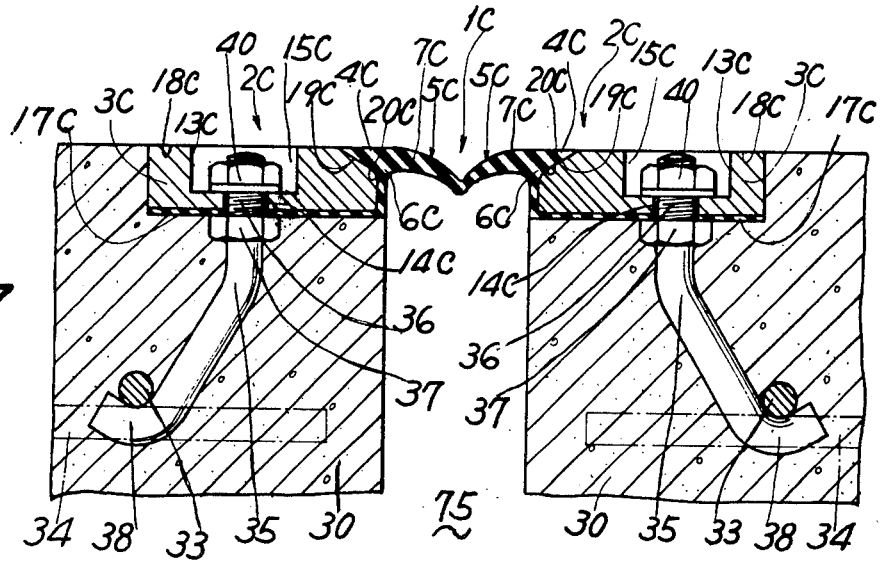

This embodiment is shown in FIG. 7. The construction of a fixing body 2c of a joint member 1c is different from that of Embodiment No. 1. Numeral 3c are horizontal base courses made of steel plates facing each other with a certain space therebetween. An upper surface 18c of the horizontal base course 3c is horizontal, and provided at the inner end of the upper surface is a slanting surface 19c to which is fixed the end portion of a short horizontal cushion course 4c made of elastic material, such as synthetic resin or the like. A wave-shape expansion plate 5c is connected to the end portion of said horizontal cushion course and to the inside of a vertical cushion course 6c. A rather thin horizontal cushion course 17c is provided under the horizontal base course 3c and is continuous to the vertical cushion course 6c. The upper surface of the upper horizontal cushion course 4c and the upper surface 18c of the horizontal base course 3c are formed horizontal on the same level. Made in the transversal direction with a certain space therebetween are stepped holes 15c. The stepped hole 15 consists of a nut hole 13c, large enough to allow a binding nut 40 to screw-fit an anchor bolt 35 which is put through the horizontal base course 3c, and of an anchor bolt hole 14c which is concentric with said nut hole and large enough to allow the anchor bolt 35 to pass therethrough. Said anchor bolt hole is bored through said horizontal cushion course 17c. Other shapes and construction and the executing sequence are the same as in the case of Embodiment No. 1. The characters of reference for the joint member 1c are represented by adding c to those of corresponding parts in Embodiment No. 1.

EMBODIMENT NO. 5

Figure 8:
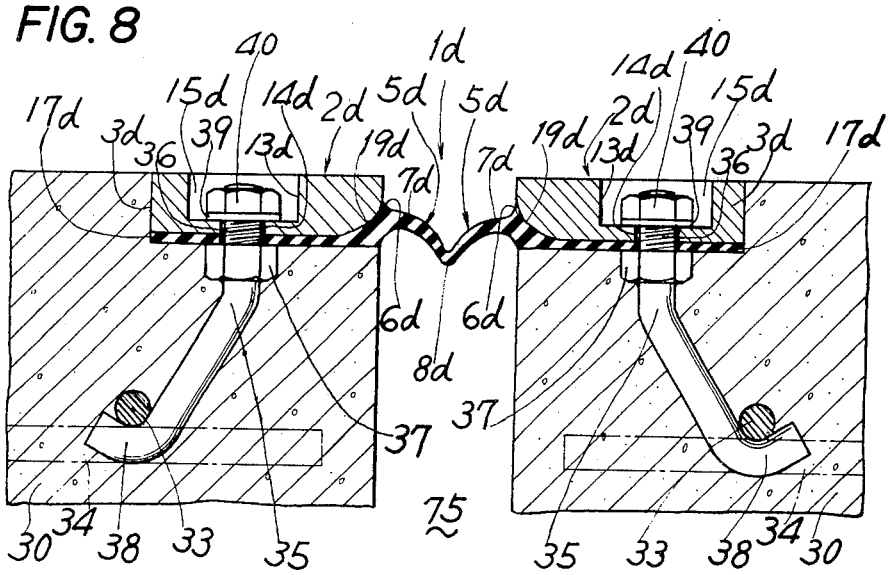

This embodiment is shown in FIG. 8 and different from Embodiment No. 4 in that in a fixing body 2d of a joint member 1d, a horizontal cushion course 17d is formed below the horizontal base course 3d. A slanting part 19d and a recessed part 20d to which is fixed a vertical cushion course 6d are provided under the horizontal base course 3d and an expansion plate 5d is connected with the horizontal base course 3d at the position lower than the upper surface of the latter. Other shapes, construction and the executing sequence are the same as in the case of Embodiment No. 1. The characters of reference for the joint member 1d are represented by adding d to those of corresponding parts in Embodiment No. 1.

EMBODIMENT NO. 6

This embodiment is shown in FIG. 9 – FIG. 11. A joint member 1e is the same as the joint member 1 in Embodiment No. 1, with the exception that a stepped protrusion 22e is provided below an end portion 21e in road width direction of an apex part 8e and a flat part 7e of an expansion plate 5e. Upon the stepped protrusion 22e, the flat part 7e and the apex part 8e of the joint member 1e are overlapped opposing the end portions in road width direction 21e. By such means the stepped protrusion 22e and the end portion 21e are joined together, which ensures perfect joint at the apex part and perfect prevention of water leakage. The characters of reference for the joint member 1e are represented by adding e to those of corresponding parts in Embodiment No. 1.

EMBODIMENT NO. 7

This embodiment is shown in FIG. 12 – FIG. 14 and is of such construction that an interlocking part is provided at the end portion, in road width direction, of a joint member 1.

In a joint member 1f, at an end portion 21f in road width direction of a fixing body 2f and an expansion plate 5f there are provided a concaved part 23f and a convexed part 24f. In the case where said concaved part and said convexed part are interlocked on a shoulder part 31 in road width direction, there is left very small gap at the interlocked part, in other words, end faces 25f and 26f are fastened together and the upper surface 18f and the under surface 27f of adjoining joint members perfectly fit to each other. The concaved part 23f and the convexed part 24f shown in the drawing are mountain-shaped at an angle of 45° ($\theta$) but may be formed in any desired shape, such as a semicircular shape. In this embodiment, the concaved part 23f and the convexed part 24f are formed at the horizontal cushion course 4f and the expansion plate 5f of the fixing body 2f and accordingly, end portions 21f of the joint member 1f are interlocked and each end portion serves to prevent the other end portion from slipping off and thus the joint member 1f can be installed firmly. Other shapes and construction and the executing sequence are the same as in the case of Embodiment No. 2. The characters of reference for the joint member 1f are represented by adding f to those of corresponding parts in Embodiment No. 1.

EMBODIMENT NO. 8

This embodiment is shown in FIG. 15. The expansion plate according to this embodiment has three waveforms. As expansion plate 5g of a joint member 1g is formed into three-wave shape by a flat part 7g and an apex part 8g. Other shapes and construction and the executing sequence are the same as in the case of Embodiment No. 1. The characters of reference for the joint member 1g are represented by adding g to those of corresponding parts in Embodiment No. 1.

EMBODIMENT NO. 9

This embodiment is shown in FIG. 16. Different from Embodiment No. 1, this embodiment uses a vertical base course made of steel material and a long vertical cushion course made of elastic material. In the joint member 1h, opposing vertical base course 28h made of steel material are provided inside a pair of horizontal base courses 3h. Each vertical base course 28h is covered with a vertical cushion course 6h made of the same material as the horizontal cushion course 4h. Said vertical base course 28h abuts the end face of a concrete pavement slab 30 and the horizontal base course 3h is mounted on a shoulder part 31. Other shapes and construction and the executing sequence are the same as in the case of Embodiment No. 1. The characters of reference for the joint member 1h are represented by adding h to those of corresponding parts in Embodiment No. 1.

EMBODIMENT NO. 10

This embodiment is shown in FIG. 17. Different from Embodiment No. 1, this embodiment is of such type that a fixing body of a joint member is fixed on a steel base on a steel plate floor.

Mounted on a main girder 70 made of steel in lengthwise direction is a steel plate floor 41. Horizontal base courses 42 made of steel and in a proper height are placed at an end portion of the joint and serve as a bed for a fixing body 2*i* of a joint member 1*i*. Welded perpendicularly to the steel plate floor 41 is a stud bolt 43 by which a joint member 1*i*, similar to one in Embodiment No. 1, is fixed on the base of the above-mentioned horizontal base plate 42. The characters of reference for the joint member 1*i* are represented by adding *i* to those of corresponding parts in Embodiment No. 1.

EMBODIMENT NO. 11

This embodiment is shown in FIG. 18. Different from Embodiment No. 1, this embodiment is of such type that a fixing body of a joint member is fixed on a fixing table on a main girder.

Steel fixing tables 44 are placed opposedly at an end portion of the joint of a main girder 70. These fixing tables are constructed of a bottom plate 45, a vertical plate 46, an upper surface plate 47, ribs 48 and reinforcing bars 49 provided at proper intervals, etc., all of which are made of steel material. The upper surface plate 47 serves as a fixing base for a fixing body 2*j* of a joint member 1*j*, similar to one in Embodiment No. 1. Provided at the back of the fixing table 44 is a concrete slab 30. Numeral 50 denotes a binding bolt for fixing the fixing body 2*j*. The characters of reference for the joint member 1*j* are represented by adding *j* to those of corresponding parts in Embodiment No. 1.

EMBODIMENT NO. 12

This embodiment is a method for installing expansion joints according to the present invention, using an anchor bolt setter. As to the method of fixing anchor bolts for installing expansion joints in the gap of pavement, various methods have been adopted at the construction field, but difficulty is found in setting a plurality of anchor bolts in concrete in perfect fit to the fixing holes of joint members, while ensuring positioning and perpendicularity of the anchor bolts. If the anchor bolt is not in position, the fixing hole of the joint member must be made larger. Also, if the anchor bolt is not correct in its extent of perpendicularity, it must be corrected by hammering. In view of such trouble, it is a usual practice to make a larger clearance between the anchor bolt and the fixing hole, which involves such a demerit that joint member, after fixed, is easy to loosen. Such demerit can be eliminated by adopting the method according to this embodiment.

The following explanation is made on an anchor bolt setter and the method of installing expansion joints, using the anchor bolt setter. The anchor bolt setter is shown in FIG. 19 – FIG. 27. It comprises mainly a member 52 in road width direction and a member 53 in lengthwise direction. The member 52 in road width direction is generally 1,800mm in length. Bolt holes 54 of a diameter larger than the diameter of the anchor bolt are made in the member 52 at regular intervals, for example at intervals of 200mm. Both members 52 and 53 are fastened together by inserting a bolt 56, fixed to a [-shape piece 55 fitted in the member 52, in a slot 57 made in the member 53 and by binding said bolt 56 by a nut 58. The space between members 52 in road width direction can be adjusted by sliding the bolt 56 in the slot 57. FIG. 24 – FIG. 26 show respectively a stepped washer 59 to engage with the bolt hole 54. The stepped washer 59 comprises a larger diameter part 60 and a small diameter part 61. The outside diameter of the small diameter part 61 is slightly smaller than the diameter of the bolt hole 54. The lower edge of the outer circumference of the large diameter part 60 is formed in a bevel 62 so that the tip of a driver, a chisel or the like can be pushed in there when the stepped washer 59 is removed off the bolt hole 54. A center hole 63 of the stepped washer 59 is made slightly larger than the outside diameter of an anchor bolt to be mentioned hereinafter. Numeral 66 denotes a washer and numeral 67 denotes a small hole.

Referring now to the method of installing expansion joints, an anchor bolt 35 is fixed by binding a nut 40 and a nut 37, after the small diameter part 61 of the stepped washer 59 is inserted in the bolt hole 54 of the member 52 and the screw part of the anchor bolt 35 is inserted in the center hole 63 of the stepped washer 59. Then, as shown in FIG. 28, an anchor bolt setter 51 is laid at the joint of pavement 75 in such a fashion that the member 53 in road width direction is bridged on a proper table arranged at the concrete pavement slab 30 on or in the same height as the upper surface of the paving course 29 of the concrete pavement slab. Post-concreting 69 is given to the underside of the anchor bolt setter. At this time, if concrete is filled sufficiently under the member 52, concrete rises through the small hole 67 onto the upper surface of the member 52, whereby it is detected that concrete has been filled sufficiently. Upon hardening of post-concreted layer 69, the upper nut 64 is removed, the stepped washer 59 is taken off the bolt hole 54 by inserting the tip of a driver in the bevelled part 62 of the large diameter part 60, whereby the anchor bolt setter 51 can be separated easily from the anchor bolt 35 and as shown in FIG. 28, the anchor bolt 35 is put in such a state that while its base part is buried in the post-concreted layer 69, its screw part 36 is exposed. Then, after the frame plates 68 have been removed, anchor bolt holes 14 of the fixing bodies 2 of the joint member 1 are engaged with anchor bolts 35 set at regular intervals, which are bound by using washers 38 and binding nuts 40, and thus joint members 1, 1*a*, 1*b* . . . can be installed. Numerals 29, 30, 33 and 34 denote a paving course, a concrete pavement slab, a main bar and distribution bars respectively.

According to the above-mentioned method of installing based on the present invention, the anchor bolt setter 51 engages with the stepped washer 59, which is fitted in the anchor bolt 35. This ensures correctness of the positioning and perpendicularity of the anchor bolt. Besides, the base part 38 of the anchor bolt slants at 30° ($\theta$) in relation to the perpendicular line, which involves an advantages that the position at which the base part 38 makes contact with the main bar can be detected easily by turning the screw part. Moreover, after the anchor bolt 35 has been set in the concrete slab, if the stepped washer 59 is removed off the bolt hole 54, the anchor bolt setter 51 can easily be removed from the anchor bolt 35.

Figure 4:
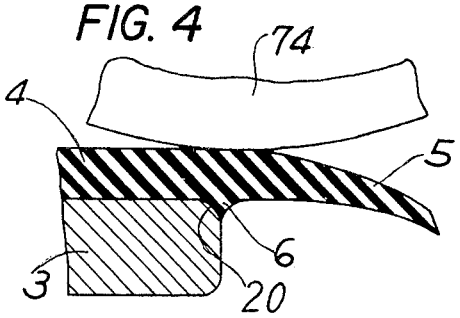

As explained above with reference to several embodiments the joint member 1 of the expansion joint according to the present invention, comprises the fixing body 2 and the expansion plate 5 which absorbs expansion and contraction of the concrete slab of the road bridge and also prevents the inroad of water, gravells, etc. through a joint spacing. The expansion joint according to the present invention is simple in construction, as compared with various types of conventional expansion joints, and accordingly provides easiness of installing and repairing at less costs. Furthermore, because of the wave-shape of the expansion plate, the expansion joint according to the present invention involves generation of very slight interior stress at its expansion and contraction. Provision of the narrow groove 9 and the protuberance of curved surface 10 at the apex part 8 imparts flexibility to the joint member. Such flexibility prevents the apex part 8 from breaking even when gravels or the like get in the upper surface of the apex part 8. Besides, in the fixing body 2, the horizontal base course 3 is stuck with, at its upper side or underside, the horizontal cushion course 4 or 17 and the vertical cushion course 6 at its side (both cushion courses are made of elastic material, such as synthetic resin). By this arrangement, even if a load is applied to the joint member when a vehicle wheel passes over it as shown in FIG. 4, shocks can be mitigated to a large extent by both cushion courses 4 and 17, with resultant prevention of vibration and noises. Thus, the exansion joint according to the present invention ensures good feeling of vehicle running and high durability to external force, such as load of vehicles passing over frequently.

FIG. 31 shows the results of tests carried out on the compression and the compressive load, which are used for measuring the change in expansion of the expansion member and stress load thereto, with regard to the Type A joint member according to the present invention (expansion — 50mm type and 100mm type) and the Type B or the prevailing accordion type (expansion — 50mm type). As shown in FIG. 31, compressive load against compression for the joint member according to the present invention was about several percent of that for the conventional expansion joint. On the right side of FIG. 31, shapes of expansion members (A & B) used for the above tests are shown. A1 is a joint member according to the present invention and B76 is a joint member of accordion type composed of a rubber member 77 and steel plates 78 which are fixed to a fixing base 73.

What I claim is:

1. A concrete roadway expansion joint for spaced apart roadway portions said roadway portions each including means to anchor a roadway expansion joint to said roadway, said roadway expansion joint comprising opposing horizontal fixing bodies for said spaced apart roadway portions; said fixing bodies including a substantially flat elastic horizontal course; a hard flat metal base course; said horizontal course and said base course fused to each other, both said horizontal course and said base course each approximately the same width over said roadway portions, an elastic expansion plate, said metal base course including a fillet and said elastic horizontal course including a rib over said fillet adjacent said expansion plate being integral with said horizontal fixing bodies for said spaced apart roadway portions; said expansion plate extending below and away from the upper plane of said spaced apart fixing bodies between said apart roadway portions when on said spaced apart roadway portions; said expansion plate including a longitudinal groove along its upper surface, a thick apex corresponding to said longitudinal groove; said apex being opposite said longitudinal groove along said expansion plate between said spaced apart roadway portions; said expansion plate tapering thinner toward said apex, and said fixing bodies including longitudinal stepped openings, each said stepped opening extending at least to said hard metal base course, said roadway's means to anchor a roadway expansion joint interactable to anchor said horizontal fixing body at said stepped openings below the plane of the top of said fixing body and said spaced apart roadway portions.

2. The invention of claim 1 wherein said roadway portions all include a recess and said horizontal fixing bodies are set in said recesses.

3. The invention of claim 1 wherein said elastic horizontal course is contiguous with said spaced apart roadway portions; upper surface.

4. The invention of claim 1 wherein said means to anchor said horizontal fixing body includes a threaded portion and a nut.

5. The invention of claim 1 wherein said means to anchor said horizontal fixing body is a nut and bolt.

* * * * *